US005387175A

United States Patent [19]

Madsen

[11] Patent Number: 5,387,175

[45] Date of Patent: Feb. 7, 1995

[54] DECANTER CENTRIFUGE WITH IMPROVED CONVEYER BEARING SUPPORT

[75] Inventor: Niels F. Madsen, Bagsvaerd, Denmark

[73] Assignee: Alfa Laval Separation A/S, Soborg, Denmark

[21] Appl. No.: 862,769

[22] PCT Filed: Dec. 27, 1990

[86] PCT No.: PCT/DK90/00345

§ 371 Date: Jun. 23, 1992

§ 102(e) Date: Jun. 23, 1992

[87] PCT Pub. No.: WO91/09680

PCT Pub. Date: Jul. 11, 1991

[30] Foreign Application Priority Data

Dec. 29, 1989 [DK] Denmark ..... 6730/89

[51] Int. Cl.[6] ..... B04B 1/20; B04B 9/00

[52] U.S. Cl. ..... 494/53; 494/64; 494/83

[58] Field of Search ..... 494/12, 46, 50, 52–54, 494/64, 83, 85; 210/363, 380.1, 380.3

[56] References Cited

U.S. PATENT DOCUMENTS

| | | | |
|---|---|---|---|
| 1,806,241 | 5/1931 | Dupuis | 494/53 X |
| 2,614,748 | 10/1952 | Ritsch | 494/85 X |
| 2,679,974 | 6/1954 | Gooch | 494/53 X |
| 3,096,282 | 7/1963 | Trotter, Jr. | 494/53 X |
| 3,282,497 | 11/1966 | Schmiedel | 494/53 X |
| 3,379,368 | 4/1968 | Gilreath | 494/54 |
| 3,423,016 | 1/1969 | Heckmann | 494/53 X |
| 3,430,850 | 3/1969 | Gilreath | 494/54 |
| 3,527,401 | 9/1970 | Bye-Jorgensen et al. . | |
| 3,534,902 | 10/1970 | Gilreath | 494/53 |
| 4,504,262 | 3/1985 | Forsberg | 494/83 X |

FOREIGN PATENT DOCUMENTS

| | | | |
|---|---|---|---|
| 1002689 | 2/1957 | Germany . | |
| 2803221 | 7/1979 | Germany | 494/83 |
| 2122513 | 1/1984 | United Kingdom . | |
| 8706856 | 11/1987 | WIPO . | |
| 8912506 | 12/1989 | WIPO | 494/53 |

*Primary Examiner*—David A. Scherbel
*Assistant Examiner*—Charles Cooley
*Attorney, Agent, or Firm*—Evenson, McKeown, Edwards & Lenahan

[57] ABSTRACT

A decanter centrifuge including a drum that is rotatably journalled at its ends includes a separating compartment defined by end walls and a rotatably journalled conveyor disposed in the separating compartment and rotatably journalled in two bearings, one located at the free end of a trunnion projecting into the conveyor body. The separating compartment has a length to diameter ratio greater than four and the trunnion has a length in the range from 0.5 to 3 times the largest diameter of the separating compartment. Due to the short distance between the conveyor bearings, the rigidity of the conveyer increases, thereby increasing the critical RPM of the drum.

4 Claims, 2 Drawing Sheets

DECANTER CENTRIFUGE WITH IMPROVED CONVEYER BEARING SUPPORT

The invention relates to a decanter centrifuge comprising a frame in which a drum is rotatably journalled in a bearing at either side of the drum and a conveyor rotatably journalled in the drum and extending throughout the separating compartment of the drum, said separating compartment being delimited in the axial direction of the drum by an end wall at either end of the drum, and in which the ratio between the length and the diameter of the separating compartment is larger than four.

In decanter centrifuges of this type an improvement of the separation effect and an increase of the capacity of the centrifuge may be obtained by increasing the number of revolutions (RPM) of the drum. The highest RPM as used depends on various factors, such as the strength of the drum material and the first critical RPM of the drum with contents. In decanter centrifuges in which the ratio $\lambda$ between the length and the diameter of the separating compartment is greater than four, the drum is comparatively slender and has a comparatively low critical RPM determining the highest allowable service RPM, generally set to about two thirds of the critical RPM.

It is the object of the invention to provide a decanter centrifuge with a drum having a critical RPM that is higher than in corresponding prior decanter centrifuges of the above mentioned type.

The decanter centrifuge according to the invention differs from the known centrifuge in that at least one of the bearings of the conveyor is supported at the free end of a trunnion extending axially into the conveyor from an end wall and that the trunnion has a length in the range from 0.5 to 3 times the largest diameter of the separating compartment.

Experiments and calculations have shown that the critical RPM of the drum to a high degree depends on the structure of the conveyor journalled in the drum. It has in particular been found that the tendency of the conveyor to deflect while rotating is of essential importance to the critical RPM of the drum and by journalling the conveyor at least at one of its ends on a trunnion projecting into the conveyor the distance between its bearings decreases and a considerably more rigid conveyor is obtained. It has been found advantageous that the trunnion has a length ranging from 0.5 to 3 times the diameter of the separating compartment. If the trunnion is shorter than 0.5 times the diameter of the separating compartment, the resulting increase of rigidity of the conveyor is not sufficiently high to exert a substantial influence on the critical RPM. If the trunnion is longer than three times the diameter of the separating compartment the conveyor becomes, on one hand, substantially more rigid but, on the other hand, the trunnion gets softer and the total result is that no substantial improvement of the critical RPM is obtained.

A preferred embodiment of the decanter centrifuge is characterized in that the portion of the conveyor surrounding the trunnion projecting into the conveyor is comparatively lighter and more fragile than the portion of the conveyor located between the conveyor bearings. The portion of the conveyor located between the bearings is dimensioned so as to have the required rigidity and to be capable of transferring the forces occurring in operation to the bearings. On the other hand, only small forces are transferred in the portion of the conveyor surrounding the inward projecting trunnion and it may therefore have a comparatively smaller mass and be more fragile than the remaining part of the conveyor. This reduces the mass of the conveyor further, thereby contributing to increasing the critical RPM and at the same time it is possible to decrease material costs as well as processing costs in manufacturing the conveyor.

The comparatively lighter and more fragile portion of the conveyor may be detachably secured to the portion of the conveyor located between the conveyor bearings and it may for instance be secured by means of a threaded joint. It is hereby obtained that upon cleansing and repairing the decanter centrifuge the lighter and more fragile portion may easily be removed and possibly replaced, if necessary due to wear.

An embodiment of a decanter centrifuge according to the invention is characterized in that the bearings of the drum are resilient. The use of resilient bearings enhances the effect of the more rigid suspension of the conveyor in the drum, thereby further increasing the critical RPM.

BRIEF DESCRIPTION OF THE DRAWINGS

The invention will now be explained in detail by an embodiment and with reference to the drawings, in which.

Figure 1:
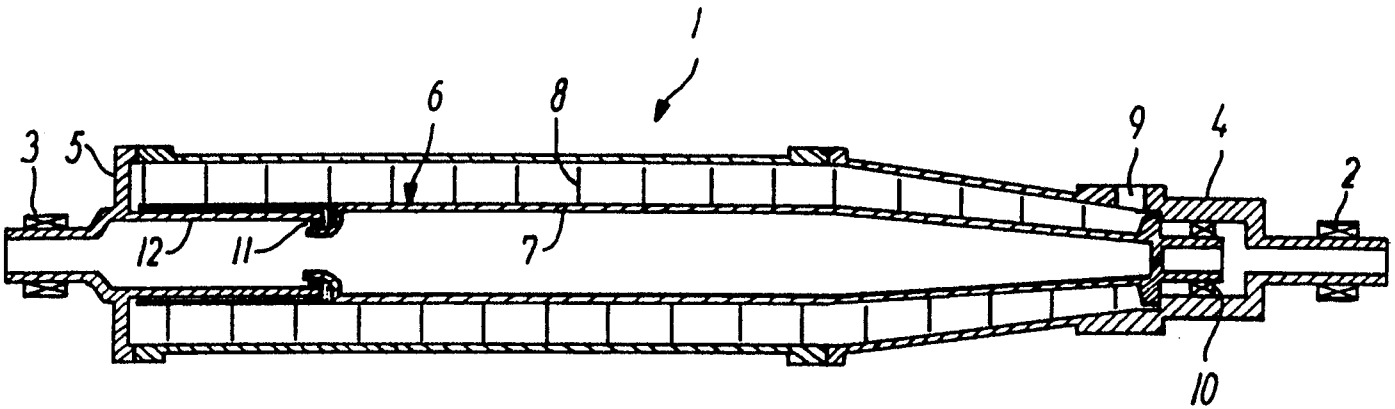
FIG. 1 is a schematical longitudinal section of a drum of a decanter centrifuge according to the invention.

At its narrow end the drum 1 illustrated in FIG. 1 has a bearing 2 and at its widest end a bearing 3 by which it is rotatably journalled in a frame, not shown. At the narrow end the separating compartment of the drum is defined by an end wall 4 and at the widest end by an end wall 5. A conveyor 6 consisting of a hollow body 7 with a screw flight 8 for the conveyance of separated solids towards an outlet 9 is journalled within the drum. At the narrow end the conveyor is journalled in a bearing 10 and at the widest end in a bearing 11. Bearing 11 is disposed at the free end of a trunnion 12 extending into the hollow conveyor body 7 and being at its other end integral with end wall 5.

Figure 2:
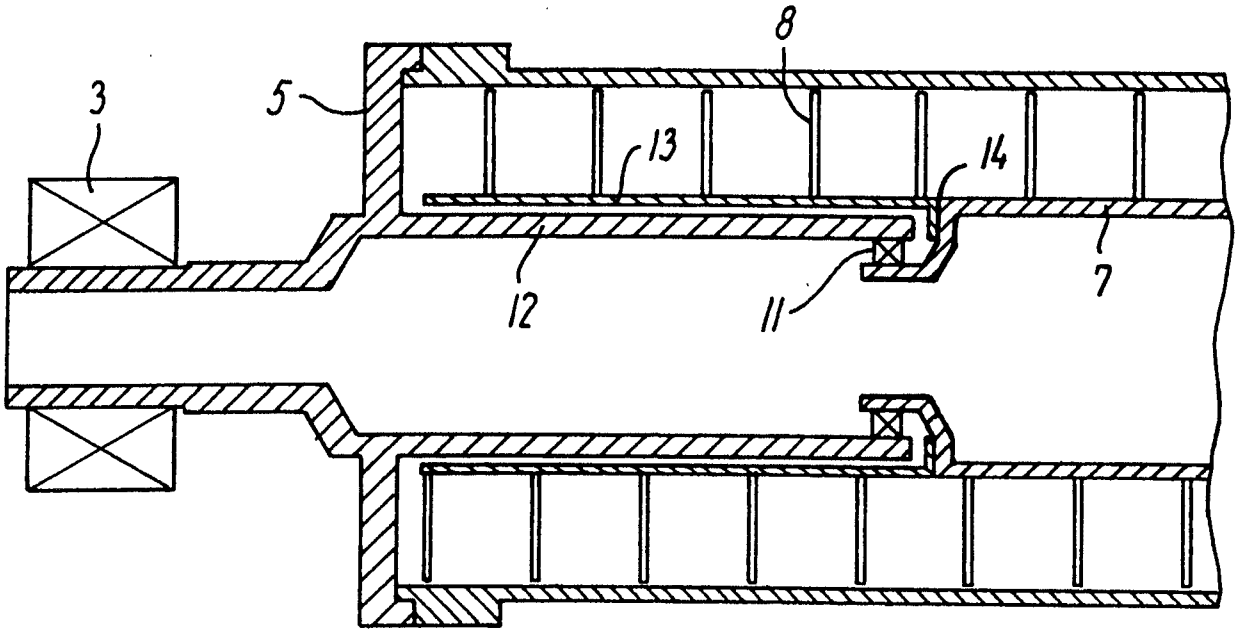
FIG. 2 is a partial view on a larger scale of the widest end of the drum illustrated in FIG. 1.

FIG. 2 shows a preferred embodiment, in which the portion 13 of the conveyor body 7 encircling trunnion 12 is designed so as to be lighter and more fragile than the portion of conveyor body 7 located between bearings 10 and 11. Portion 13 may for instance be made from thin sheet in order to reduce the mass of said portion. In the figures trunnion 12 is shown to be integral with end wall 5, but it may as well be designed as a separate trunnion 12, e.g. bolted onto end wall 5.

In an embodiment, not shown, the joint shown at 14 between portions 13 and 7 of the conveyor body may be designed as a threaded joint.

In the preceding trunnion 12 is shown and described to be positioned at end wall 5 at the widest end of the drum. It is also possible to locate an extended trunnion of this type projecting into the conveyor body at the narrow end of the drum, but due to the confined space prevailing there it may be difficult to obtain sufficient rigidity of the trunnion. According to the invention it is finally possible to provide inward projecting trunnions at both ends of the drum.

What is claimed is:

1. A decanter centrifuge comprising:

a drum rotatably journalled at each end thereof;

a separating compartment defined inside the drum by two end walls, one of said end walls being located at each end of the drum, said separating compartment having a ratio of length to largest diameter greater than four; and a conveyor rotatably journalled in the drum in two conveyor bearings and extending throughout the separating compartment, wherein at least one of the conveyor bearings is supported at a free end of a trunnion extending into the conveyor beginning at one of the end walls, and the runnion has a length from 0.5 to 3 times the largest diameter of the separating compartment.

2. A decanter centrifuge as claimed in claim 1, wherein a first portion of the conveyor, surrounding the trunnion, is lighter and more fragile than a second portion of the conveyor located between the conveyor bearings, and the first portion does not support the conveyor bearing.

3. A decanter centrifuge as claimed in claim 2, wherein the first portion of the conveyor is detachably secured to the second portion of the conveyor.

4. A decanter centrifuge comprising:

a drum rotatably journalled at each end thereof;

a separating compartment defined inside the drum by two end walls, one of said end walls being located at each end of the drum, said separating compartment having a ratio of length to largest diameter greater than four; and a conveyor rotatably journalled in the drum in two conveyor bearings and extending throughout the separating compartment, wherein at least one of the conveyor bearings is supported at a free end of a trunnion extending into the conveyor beginning at one of the end walls, and the trunnion has a length from 0.5 to 3 times the largest diameter of the separating compartment, wherein a first portion of the conveyor, surrounding the trunnion, is lighter and more fragile than a second portion of the conveyor located between the conveyor bearings, and wherein the first portion of the conveyor is detachably secured to the second portion by a threaded joint.

* * * * *